United States Patent [19]

Hoshino

[11] Patent Number: 4,829,874

[45] Date of Patent: May 16, 1989

[54] SUPPORT FOR BASS DRUMS

[75] Inventor: Yoshihiro Hoshino, Nagoya, Japan

[73] Assignee: Hoshino Gakki Co., Ltd., Japan

[21] Appl. No.: 213,086

[22] Filed: Jun. 29, 1988

[30] Foreign Application Priority Data

Oct. 13, 1987 [JP] Japan ..... 62-156464[U]

[51] Int. Cl.[4] ..... G10G 5/00

[52] U.S. Cl. ..... 84/421; 84/422.1

[58] Field of Search ..... 84/421, 422 R

[56] References Cited

U.S. PATENT DOCUMENTS

| | | | |
|---|---|---|---|
| 516,612 | 3/1894 | Rappold | 84/422 R |
| 924,302 | 6/1909 | Anderson | 84/422 R |
| 994,289 | 6/1911 | Unger | 84/421 |
| 1,022,149 | 4/1912 | Maphet | 84/421 |
| 2,445,486 | 7/1948 | La Londe | 84/422 R |
| 2,505,882 | 5/1950 | Cassato | 84/421 |
| 2,563,346 | 8/1951 | Livingston | 84/412 |
| 4,126,075 | 11/1978 | Kurosaki | 84/421 |

FOREIGN PATENT DOCUMENTS

| | | | |
|---|---|---|---|
| 1144532 | 3/1969 | United Kingdom | 84/421 |

*Primary Examiner*—Lawrence R. Franklin

*Attorney, Agent, or Firm*—Ostrolenk, Faber, Gerb & Soffen

[57] ABSTRACT

A bass drum support to position the drum beating spot at a desired height, to prevent stress at the connection of the drum to a foot pedal operated drum beater and to minimize transmission of vibration from the drum body to the support and the foot pedal. A front support leg is supported at the center of the front end of the body of the drum through a vibration absorption set, made, for example, of rubber. A pair of rear support legs extend to the rear part of the drum body and are resilient. The lengths of the legs are adjustable. The rear legs are inclined forwardly of the drum body. Clamping of the front end of the drum by the drum beater pedal assembly is avoided.

9 Claims, 4 Drawing Sheets

FIG. 2.
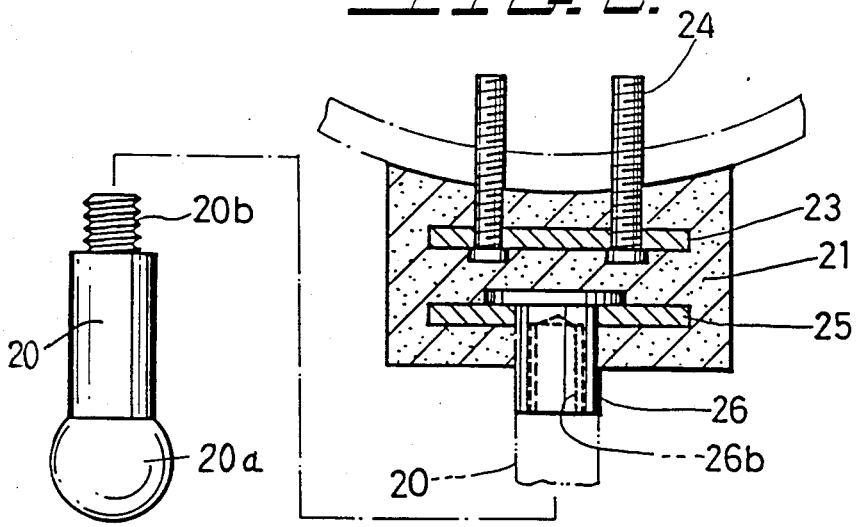
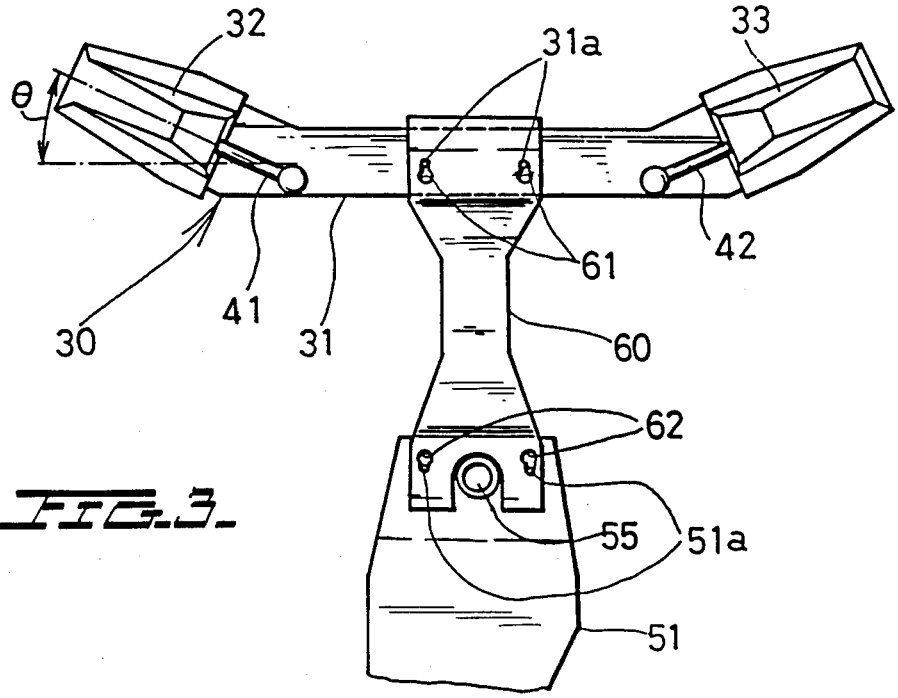
FIG. 3.

SUPPORT FOR BASS DRUMS

BACKGROUND OF THE INVENTION

1. Field of the Invention

The present invention relates to a support for a drum, primarily for a bass drum, for holding the drum at a prescribed beating position at a selected height and tilt orientation. The invention has application to any drum supported with its axis horizontal, particularly where the drum is disposed at the floor.

2. Brief Description of the Prior Art

A known support for a bass drum is shown in FIG. 7 of the drawings accompanying this application. It comprises support legs 83 attached to the drum body by means of respective installation metal plates 82 which are disposed around the drum body just off the bottom of the drum body on both sides of the bottom and also toward the axial rear end of the drum body, that is, away from the front, beating end of the drum. Further, a clamp 91 at the tip of the foot pedal 90 for the drum beater is clamped to a drum head securing hoop metal 85 located at the front end of the drum. The legs 93 and the clamp 91 hold the drum at a prescribed beating location.

In this conventional structure, the clamp 91 is upraised off the floor so as to support the front of the drum at the same height as the rear of the drum. The front of the drum body is held up in a somewhat floating manner because the support legs at the rear portion of the drum body and the metal hoop 85 at the front are sandwiched by the clamp 91 of the foot pedal at the front end. This applies localized force to the metal hoop 85 at the front end, which tends to produce localized deformations. This causes an unsightly exterior appearance of the drum. More seriously, since the metal hoop 85 tightens and secures the drum head 84, hoop deformation also produces a problem with respect to variation in drum tuning due to unexpected differential tightening of the drum head 84.

This prior art support also causes a problem in the rear portion of the drum body because the entire load is concentrated on the support leg installation plates that are affixed to the drum body. These plates are especially stressed by the beating of the drum beater during a drum performance. As a result, the connections to the drum body at those plates become fatigued and developed strains. Further, the vibration of the drum body is transmitted through the installation plates, which unfavorably affects the reproduction of drum sound.

SUMMARY OF THE INVENTION

The present invention seeks to eliminate the foregoing problems of the prior art. This invention offers a new support for a bass drum which prevents the localized forces from being applied to the metal hoop at the front of the drum, thereby preventing deterioration of the exterior appearance of the hoop and the variation in drum tuning and also eliminating strains that previously developed at fixed attachments of support legs at the rear part of the drum body.

The support of the present invention holds the bass drum at a prescribed beating position by means of rear legs located at the rear of the drum body and a front leg located at the front of the drum body, the front leg extending to a receiving stopper on a foot pedal drum beater unit. The front leg supports the center of the front end of the drum body through a vibration absorption seat disposed on the drum body. The front leg is freely detachable from the stopper. A pair of rear legs simply carry the rear part of the drum body. The rear legs are inclined up to the drum body and are also inclined forwardly toward the front of the drum, which opposes the force of drum beater applied from the front. The rear legs are expandable and contractible, and the front leg may also be made that way, to establish the height and desired orientation of the drum body.

The foregoing and many other features of the present invention will become apparent in the following description and accompanying drawings.

BRIEF DESCRIPTION OF THE DRAWINGS

FIG. 2 is a cross sectional view showing the front leg and its vibration absorbing seat of the bass drum.

FIG. 3 is a plan view of an entire support arrangement for the drum.

DESCRIPTION OF THE PREFERRED EMBODIMENTS

Figure 1:
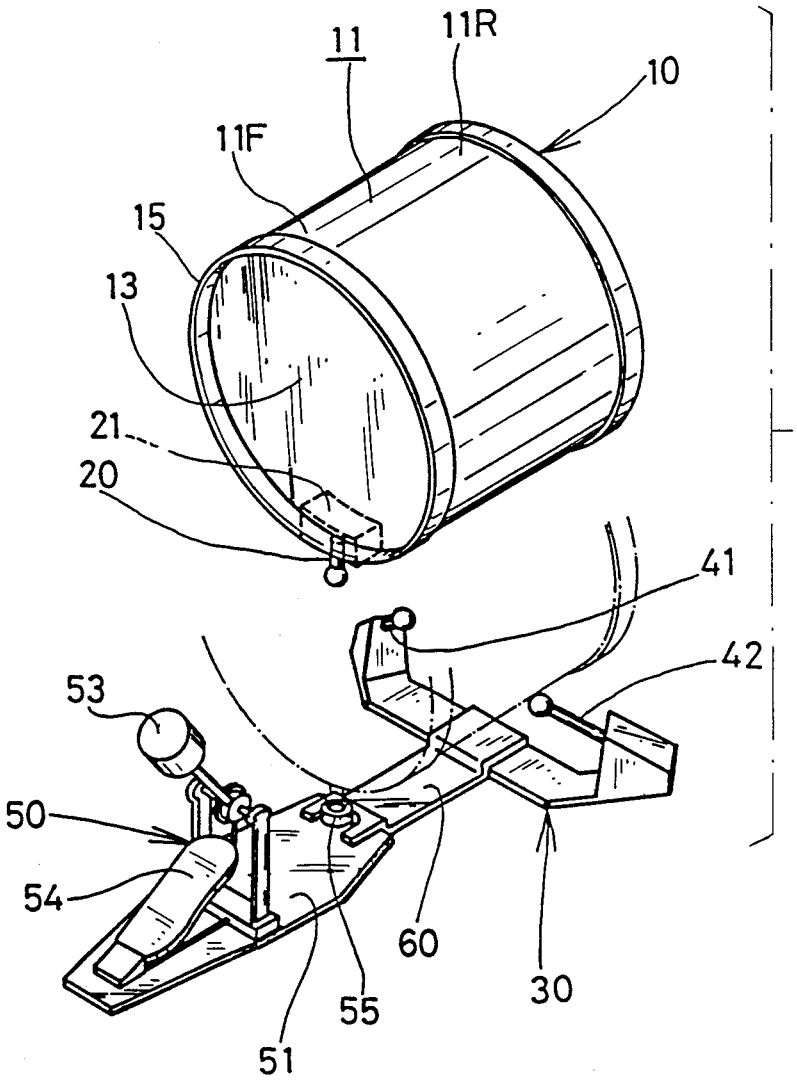
FIG. 1 is an exploded perspective view of a holding structure of the present invention for a bass drum.

The invention supports a bass drum 10 at a prescribed beating position by means of a support arrangement 30 and a foot pedal 50 for being struck by a drum beater 53.

The drum 10 has a rigid cylindrical body or trunk and has drum heads attached at its opposite front 11F and rear 11R ends. Each drum head is supported by height but is thin enough that it bends upon localized application of force to it.

A front supporting leg 20 is provided at the center of the bottom of the front end 11F of the drum body 11 through a vibration absorbing seat 21. At the below described foot pedal 50, a leg stopper 5 is provided for the front leg 20. A pair of rear support legs 41 and 42 extend up from the support arrangement 30 to engage the drum body toward the rear end 11R. The drum body simply rests on the ends of the legs 41 and 42.

Referring to FIG. 2, the front leg 20 is installed in a freely detachable manner on the vibration absorbing seat 21. The front leg 20 has a ball **20*a* made of a resinous material at its lower end and has an attaching screw thread 20*b* at its top for attachment of the leg to the seat 21. The length of the front leg is initially selected in accordance with the diameter of the bass drum, its desired height off the floor and the place on its drum head surface where the beater 53** is to strike.

The vibration absorption seat 21 is formed as a whole of a vibration absorbing material, such as rubber. Drum side fixing screws 24 extend from the drum side installation plate 23, which is embedded in the seat 21, into the side wall of the drum body and fix the seat to the drum body. The leg side installation plate 25, which is also embedded in the seat 21, supports a nut 26 which extends below the seat 21. The nut 26 has an internal screw **26*b* that receives the screw 20*b* on the front leg 20. The plates 23 and 25, along with the respective drum side fixing side screws 24 and the nut 26, are separated from each other in the seat 21, and vibration of the drum body is not transmitted to the leg 20**.

Referring to FIG. 3, the support arrangement 30 includes a wide base plate 31. The plate 31 carries a respective block 32 and 33 on the right and left ends. The blocks, in turn, carry and orient respective drum support legs 41 and 42. The support legs 41 and 42 are inclined from the vertical so as to engage the drum body essentially radially. As seen in FIG. 3, the legs are also inclined at angle $\theta$ of incline of approximately 20° as compared with the base plate 31, and therefore at the complementary angle to $\theta$ from the drum axis, so that the drum is held somewhat from the rear direction which resists rearward movement of the drum as it is beaten. Hook 31*a* is defined on the base plate 31 for connecting it to the connector 60.

Figure 4:
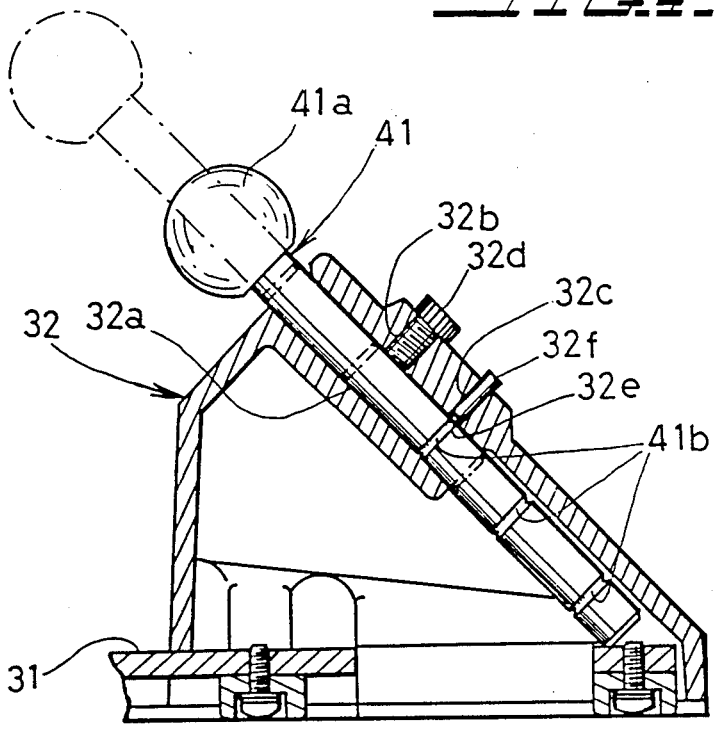
FIG. 4 is a cross section of a support leg.

FIG. 4 shows the structures of one support leg 41 and one block 32. The support leg 41 is expandable and contractible. It comprises a ball part 41*a* comprised of a vibration absorbing material, such as rubber, positioned at the upper end of the support leg 41 on which the drum body rests. Annular grooves 41*b* for positioning purposes are formed at various locations along the length of the leg. The support leg 41 is inserted into inclined angled passageway 32*a* provided in the block 32.

A threaded screw hole 32*b* in the block 32 intersects the passageway 32*a*. An additional positioning hole 32*c* in the block 32 also intersects that passageway. A bolt 32*d* is screwed into the hole 32*b* to secure the support leg 41. A pin 32*f* carrying an exit-entry ball 32*e* at its tip is inserted into the hole 32*c* to engage a selected annular groove 41*b* of the support leg for setting the precise length of the leg prior to tightening the bolt 32*d*. This positions the leg 41 at specific locations at which bolt 32*d* then secures the leg.

In FIG. 3, a connector 60 connects the base plate 31 with a drum beater support 51. The connector 60 spaces the pedal and the drum support arrangement 30 apart. A hook 51*a* is provided on the support 51. Respective engagement holes 61 and 62 for the hooks 31*a* and 51*a* are provided on the connector 60.

The foot pedal unit 50 is set on the support 51. A stopper 55 is provided on the support. It engages the forked end of the connector 60 and that positions the pedal unit 50. A depression defined at the top of the stopper is shaped for readily removably receiving the bottom end of the leg 20. The foot pedal 50 unit is provided with a beater 53 having a padded head and a pedal 54 that pivots to in turn rotate the beater to hit the drum head.

Figure 5:
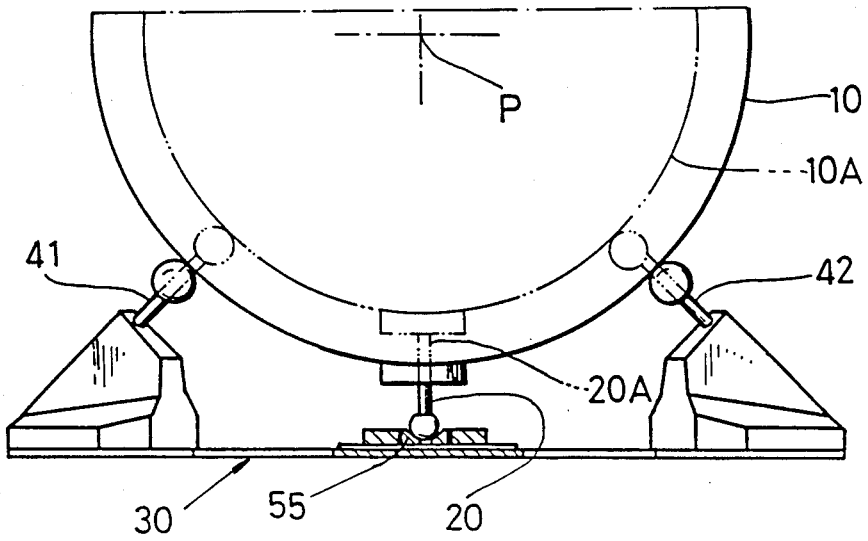
FIG. 5 is a view showing set conditions of the bass drum, the pedal and the support member.

FIG. 5, shows set states of the bass drum. Bass drums 10 and 10A have different diameters. The heights and positions of their centers P can be maintained the same, so that the drum beater head will hit the same area of every drum head. For this, it is sufficient to change the length of the front leg 20 to the length of the front leg 20A and to change the lengths of the support legs 41 and 42 correspondingly.

Figure 6:
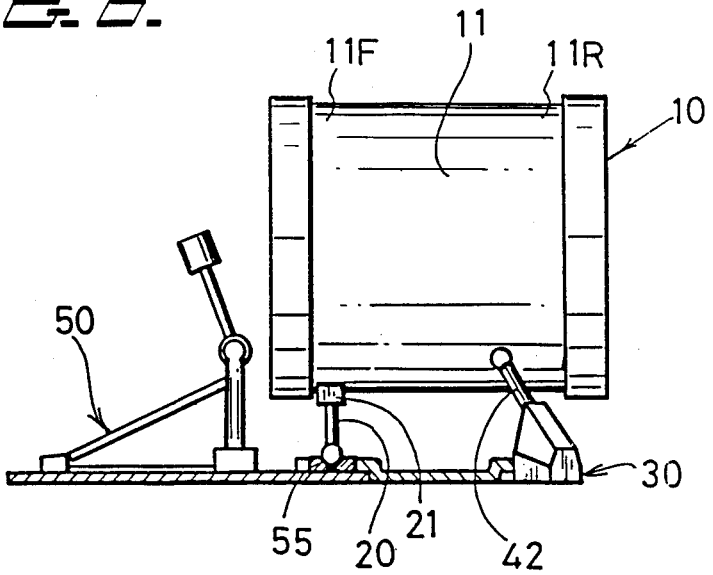
FIG. 6 is a side view of the bass drum, support member and pedal.
Figure 7:
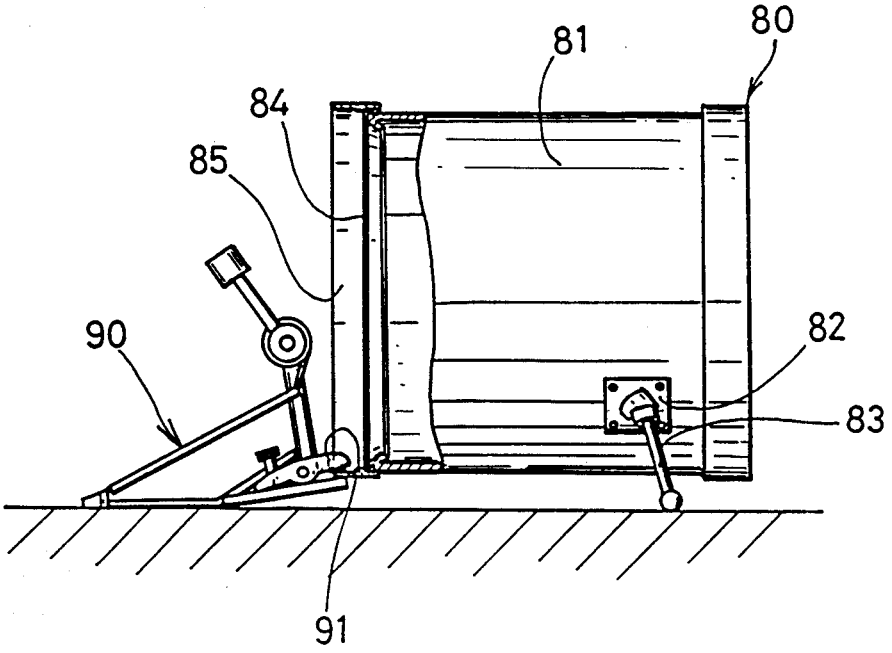
FIG. 7 is a side view of a conventional drum support.

The side view of the bass drum support according to the present invention is shown in FIG. 6. Comparing it with a conventional support of FIG. 7, there is no possibility for the metal drum hoop 15 in FIG. 6 to be deformed, or pressed down or sandwiched by the clamp of the foot pedal as in the conventional device. In addition, there is no change in the tuning of the drum which might result from such deformation. In the present drum support, the rear part 11R of the drum body can be held in a comparatively free state by means of the support legs 41, 42. This avoids application of unreasonable force to the drum body and no difficult strains or forces will develop.

Through support of the present invention, vibration of the drum body 11 is not transmitted to the front leg 20 by the vibration absorbing seat 21. There is only a low level of transmission of vibration from the rear part of the drum body, since the rear part merely rests on the support legs 41, 42. The invention permits holding the drum such that the spot of the beating on the drum head may remain the same from drum to drum by means of a change in the lengths of the support legs.

In the foregoing, the present invention has been described in connection with an embodiment thereof. Since many variations and modifications of the present invention will now be obvious to those skilled in the art, it is preferred that the scope of the present invention be determined not by the specific disclosures herein contained, but only by the appended claims.

What is claimed is:

1. A drum support for the body of a drum, wherein the drum is supported above a surface with the axis of the drum horizontal, the drum body having a front end, the drum body having an opposite rear end;

the drum support comprising:

a front leg extending beneath the drum toward the surface above which the drum is supported; a resilient connection between the front leg and the drum body for damping transmission of vibration from the drum body to the front leg;

a rear support toward the rear end of the drum body for providing support for the rear end of the drum body; the rear support comprising first and second rear legs supported by the surface above which the drum is supported at an angle to enable the rear legs to contact the drum body for raising the drum body off the surface, and each of the rear legs including an end portion on which the drum rests without the drum body being secured thereto.

2. The drum support of claim 1, wherein the rear legs are oriented to be inclined upwardly from the surface above which the drum is supported toward the drum body and are also inclined toward the front end of the drum body, wherein the angle at which the rear legs contact the drum body is counter to motion of the drum body rearwardly.

3. The drum support of claim 2, wherein the rear legs include vibration absorbing material at the end portions thereof on which the drum body rests.

4. The drum support of claim 2, wherein the resilient connection for the front leg comprises a body of resilient material; a first plate embedded in the resilient material body and a first attaching element between the first plate and the drum body; a second plate embedded in the resilient material body and spaced from the first plate and a second attaching element between the second plate and the front leg; and the first and second plates being spaced apart and out of contact.

5. The drum support of claim 1, wherein the front leg and the rear legs are adjustable in height for adjusting the angle of tilt orientation of the drum axis and the height of the drum body.

6. The drum support of claim 1, further comprising a common support for both of the rear legs and the common support including a receiving mount for the front leg.

7. The drum support of claim 4, wherein the common support includes means thereon for supporting the drum beater and for spacing the drum beater from the front end of the drum body.

8. In combination, the drum support of claim 1 and a drum beater disposed in front of the front of the drum and in front of the front leg, the beater being placed for beating the drum at the front end of the drum body; means connected with the drum beater for moving the drum beater to beat the drum, wherein the drum beater and the means for moving the drum beater are not connected to the drum body.

9. The drum support of claim 1, wherein the resilient connection for the front leg comprises a body of resilient material; a first plate embedded in the resilient material body and a first attaching element between the first plate and the drum body; a second plate embedded in the resilient material body and spaced from the first plate and a second attaching element between the second plate and the front leg; and the first and second plates being spaced apart and out of contact.

* * * * *